US008257006B2

(12) United States Patent
Konno et al.

(10) Patent No.: US 8,257,006 B2
(45) Date of Patent: Sep. 4, 2012

(54) BOOKBINDING DEVICE

(75) Inventors: Hikoyuki Konno, Tokyo (JP); Kuniaki Kimura, Tokyo (JP)

(73) Assignee: Gradco (Japan) Ltd., Tokyo (JP)

( * ) Notice: Subject to any disclaimer, the term of this patent is extended or adjusted under 35 U.S.C. 154(b) by 266 days.

(21) Appl. No.: 12/660,714

(22) Filed: Mar. 3, 2010

(65) Prior Publication Data

US 2010/0254783 A1 Oct. 7, 2010

(30) Foreign Application Priority Data

Apr. 6, 2009 (JP) ..... 2009-91666

(51) Int. Cl.

| | |
|---|---|
| ***B42B 5/08*** | (2006.01) |
| ***B42F 3/02*** | (2006.01) |
| ***B42F 13/30*** | (2006.01) |
| ***B42F 1/00*** | (2006.01) |
| ***A44B 1/04*** | (2006.01) |
| ***A44B 11/25*** | (2006.01) |
| ***A44B 17/00*** | (2006.01) |

(52) U.S. Cl. ..... 412/7

(58) Field of Classification Search ..... 412/7, 38–40, 412/42; 402/48, 52, 54, 56, 20, 80 P, 501; 281/19.1, 27.1, 28; 24/67 R, 67 P
See application file for complete search history.

(56) References Cited

U.S. PATENT DOCUMENTS

| | | | | |
|---|---|---|---|---|
| 651,950 | A * | 6/1900 | Morden | 402/20 |
| 868,746 | A * | 10/1907 | York | 281/28 |
| 917,773 | A * | 4/1909 | Leach | 402/48 |
| 1,674,265 | A * | 6/1928 | Roeger | 402/48 |
| 2,435,561 | A * | 2/1948 | Spinner | 281/28 |
| 3,839,759 | A * | 10/1974 | Staats et al. | 412/7 |
| 5,018,895 | A * | 5/1991 | Meier, Jr. | 402/20 |
| 6,113,298 | A * | 9/2000 | Miro | 281/27.1 |
| 2006/0263173 | A1 * | 11/2006 | Yoshie | 412/7 |

* cited by examiner

*Primary Examiner* — Edward Tolan
*Assistant Examiner* — Kyle Grabowski
(74) *Attorney, Agent, or Firm* — Flynn, Thiel, Boutell & Tanis, P.C.

(57) ABSTRACT

A bookbinding device includes a plurality of annular binders corresponding to binding holes. A part of an annular binder is inserted into a binding hole to be engaged, and by virtue of the insertion of the annular binder into the corresponding binding hole, the sheet bundle is bound to be provided as a booklet. Respective ends of binding members engage with each other, whereby the binding members are unified. The binding members are disposed so as to be aligned and constitute respectively binding member units which can be separated one by one. The pairs of the binding members are located in sequence so as to correspond to the binding holes to be pushed and moved and, thus, to be inserted through the binding holes. The respective ends of the binding members then engage with each other, whereby the binding members are unified.

1 Claim, 5 Drawing Sheets

(a)

(b)

BOOKBINDING DEVICE

BACKGROUND OF THE INVENTION

1. Field of the Invention

This invention relates to a bookbinding device which provides a booklet from a bundle of recording sheets.

2. Description of the Related Art

For example, in the bookbinding of a booklet such as a notebook, a sketchbook, and a picture book, a plurality of binding holes are continuously formed at the end of the booklet, and a coiled binder is inserted into the binding holes from the end while being rotated.

Meanwhile, for example, an electrophotographic image-forming apparatus has high-speed performance, multiple functions, and network functions, and when the image forming apparatus is connected with a high capacity sheet feeder and a high capacity stacker, the application as a printer is expanded.

As bookbinding processing of a printed matter printed by the printer, there has been known a bookbinding processing that, for example, a U-shaped binding needle is inserted into one end of a bundle of accumulated printed sheets, and both ends are folded inward, whereby the one end of the sheet bundle is bound to provide a booklet (refer to Japanese Patent Application Laid-Open No. 10-198105).

When the coiled binder is inserted into the binding holes from the end while being rotated, it takes time for the insertion, and it is difficult to insert the binder into a proper position in the bookbinding.

Meanwhile, in the bookbinding device disclosed in Japanese Patent Application Laid-Open No. 10-198105, the U-shaped binding needle is inserted on the sheet post-processing apparatus side, and both ends are folded inward, whereby one end of the sheet bundle is bound to provide a booklet. Therefore, a folding defect easily occurs, and it is difficult to realize reliable binding. Meanwhile, when an image-forming system includes a sheet post-processing apparatus, if a failure occurs in the sheet post-processing part, image recording should be performed again from the beginning.

When the number of recording sheets is large, the thickness of the sheet bundle is increased, so that it is difficult to insert the U-shaped binding needle into the sheet bundle and fold both ends inward. In addition, a folding defect easily occurs, and thus, according to the thickness of a sheet bundle, the sheet bundle cannot be bound to be provided as a booklet.

SUMMARY OF THE INVENTION

In view of the above problem, this invention provides a bookbinding device, which can reliably bind a sheet bundle, depending upon the thickness, can eliminate bookbinding failure, and can provide a high-quality booklet.

In order to solve the above problem and achieve the object, this invention is constituted as follows.

In a first aspect of the invention, there is provided a bookbinding device, which bundles recording sheets, including at its one end a plurality of binding holes formed so as to penetrate through the recording sheets, and binds the bundle of recording sheets at the plurality of binding holes to provide the bound bundle of recording sheets as a booklet. The bookbinding device includes a plurality of annular binders corresponding to the plurality of binding holes. A part of the annular binder is inserted into the binding hole to be engaged. The annular binders are inserted into the corresponding binding holes to bind the bundle of recording sheets, whereby the bound bundle of recording sheets is provided as a booklet. The annular binder includes a pair of first and second binding members, and the respective ends of the first and second binding members are engaged with each other, whereby the first and second binding members are unified.

In a second aspect of the invention, there is provided the bookbinding device according to the first aspect. The bookbinding device is characterized in that the first and second binding members are disposed so as to be aligned and constitute respectively first and second binding member units which can be separated one by one.

In a third aspect of the invention, there is provided the bookbinding device according to the first and second aspects. The bookbinding device is characterized in that the pairs of first and second binding members are located in sequence so as to correspond to the binding holes, the first and second binding members are respectively pushed and moved, a part of the pair of first and second binding members is inserted into the binding hole, and the respective ends of the first and second binding members are engaged with each other, whereby the first and second members are unified.

In a forth aspect of the invention, there is provided the bookbinding device according to the third aspect. The bookbinding device is characterized in that the bookbinding device further includes a first holder which has an opening through which the first binding members located at the end of the first binding member unit stored in the first holder are separated one by one to be pushed out, first biasing means which biases the first binding member unit in the first holder to the direction of the opening, first pushing means which separates, one by one, the first binding members, located at the end of the first binding member unit, to push the separated first binder member out of the first binding member unit, a second holder which has an opening through which second binding members located at the end of the second binding member unit stored in the second holder are separated one by one to be pushed out, second biasing means which is disposed in the second holder and biases the second binding member unit to the direction of the opening, and second pushing means which separates, one by one, second binding members located at the end of the second binding member unit to push the separated second binding member out of the second binding member unit, and the first binding members located at the end of the first binding member unit are separated one by one to be pushed out, the second binding members located at the end of the second binding member unit are separated one by one to be pushed out, and the respective one ends of the first and second binding members are inserted into each of the binding holes of the sheet bundle to be engaged with each other, whereby the first and second binding members are unified.

According to the above constitution, this invention has the following effects.

According to the invention of the first aspect, a part of an annular binder is inserted through a binding hole to be engaged, and by virtue of the insertion of the annular binder into corresponding binding holes, a sheet bundle can be easily and reliably bound to be provided as a booklet. The sheet bundle can be reliably bound, depending upon the thickness, bookbinding failure can be eliminated, and a high-quality booklet can be provided. The annular binder includes a pair of binding members, and the respective ends of the binding members are engaged with each other, whereby the binding members are easily and reliably unified, and a binding defect such as a folding defect can be prevented.

According to the invention of the second aspect, the pair of binding members is disposed so as to be aligned to constitute respectively the binding member units which can be separated one by one. Consequently, the binding members can be continuously inserted into the binding holes to be engaged, whereby a sheet bundle can be easily and reliably bound to be provided as a booklet.

According to the invention of the third aspect, the pairs of binding members are located in sequence so as to correspond to the binding holes. Each of the pair of binding members is pushed and moved to be continuously inserted through the binding holes and, thus, to be engaged, whereby a sheet bundle can be easily and reliably bound to be provided as a booklet.

According to the invention of the fourth aspect, the first binding members located at the end of the first binding member unit are separated one by one to be pushed out, and the second binder members located at the end of the second binding member unit are separated one by one to be pushed out. The respective one ends of the first and second binding members are inserted into each of the binding holes of a sheet bundle to be engaged with each other, whereby the first and second binding members are unified. According to this constitution, the sheet bundle can be reliably bound depending upon the thickness, bookbinding defects can be eliminated, and a high-quality booklet can be provided.

DESCRIPTION OF THE EMBODIMENTS

Hereinafter, an embodiment of this invention will be described. The embodiment of this invention shows the best mode of the invention, and the invention is not limited to the embodiment.

Bookbinding Device 10

Figure 1:
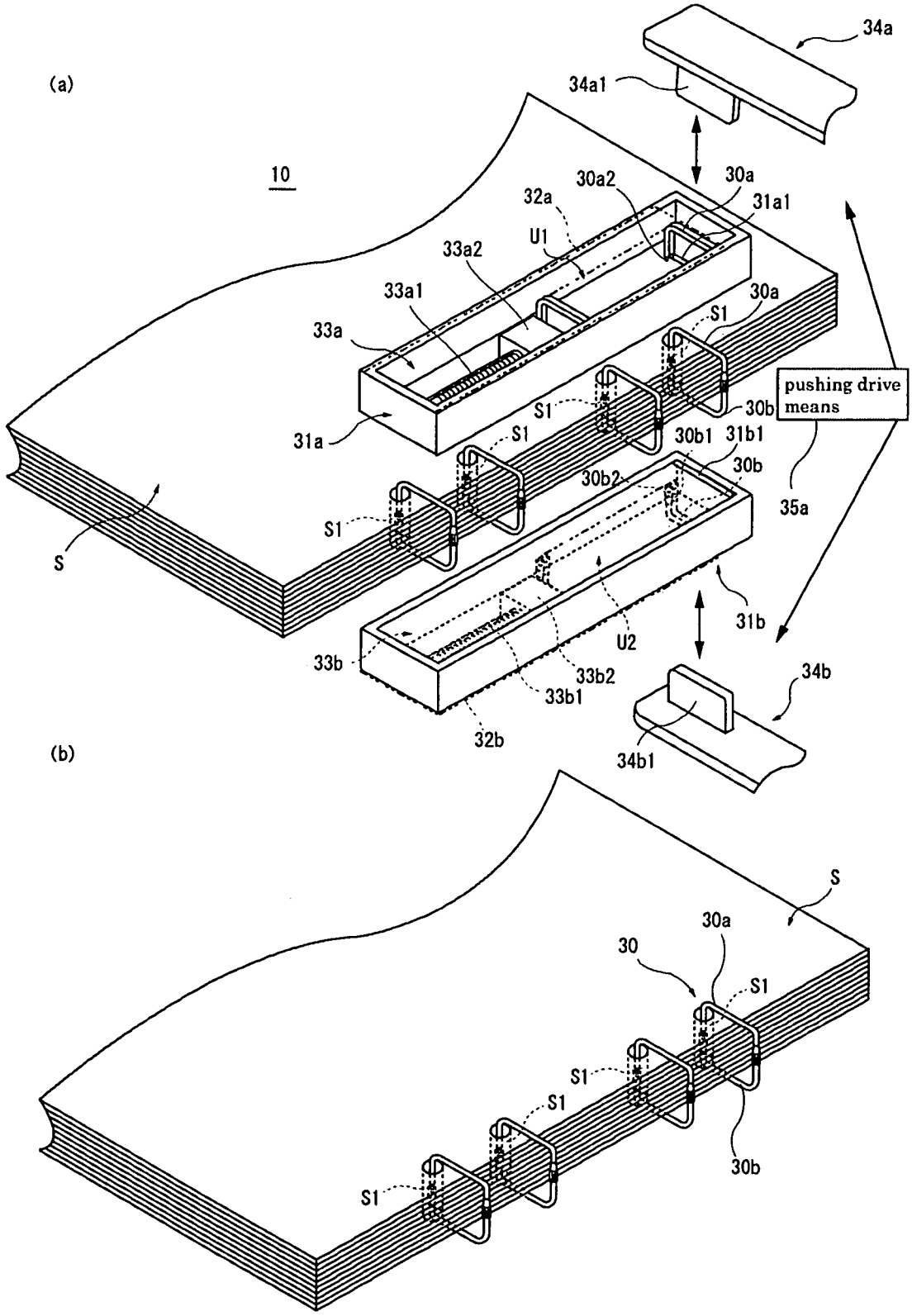
FIGS. 1A and 1B are configuration diagrams of an annular binder mounting means of a bookbinding device.
Figure 2:
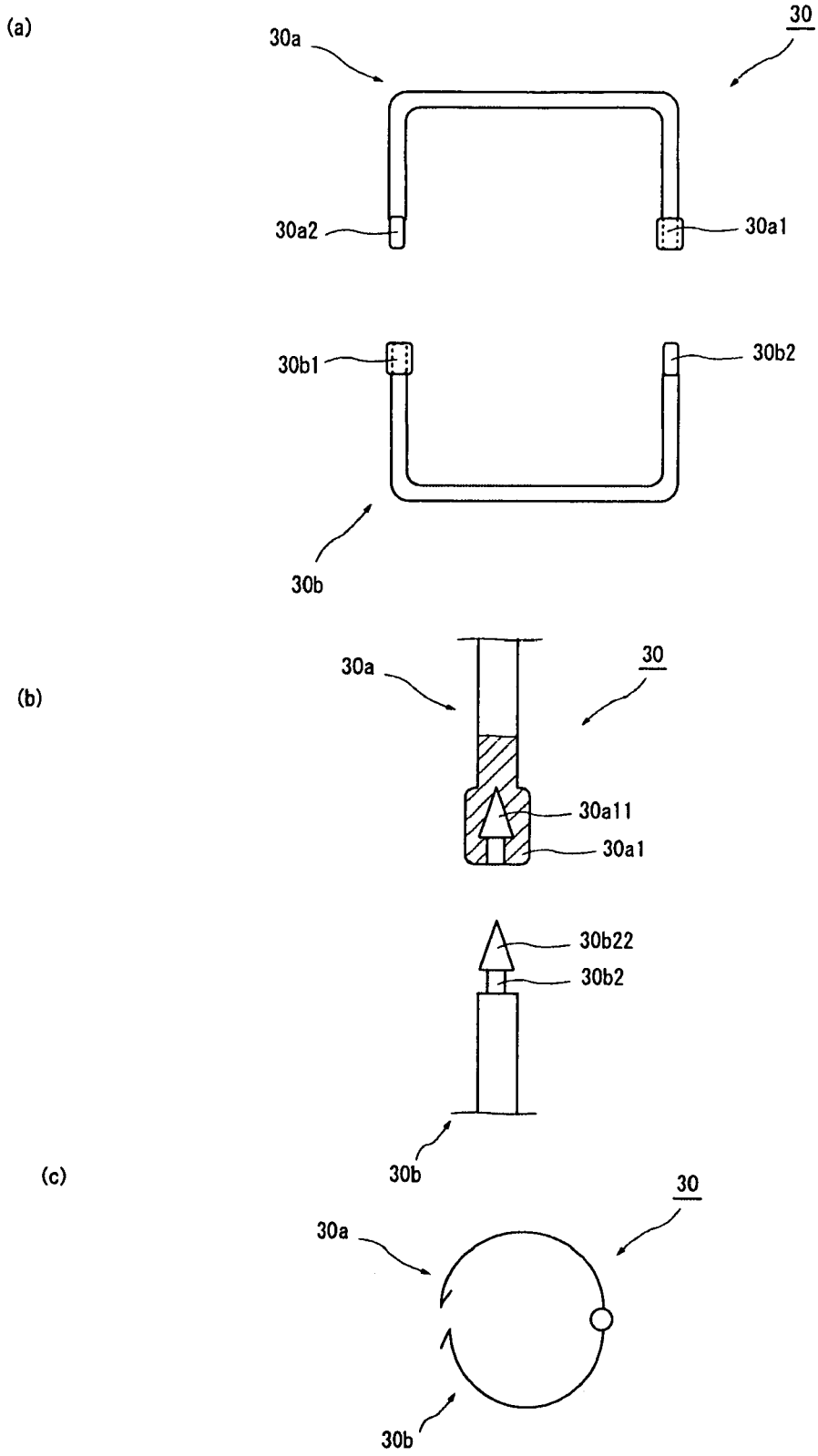
FIGS. 2A to 2C are configuration diagrams of an annular binder.
Figure 3:
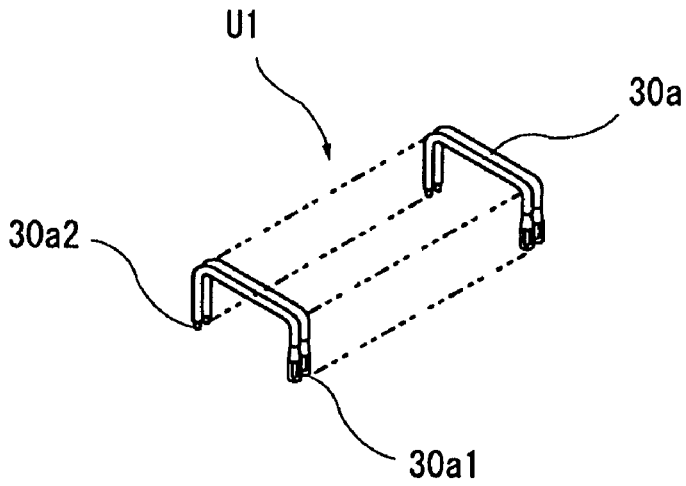
FIGS. 3A and 3B are views showing units of the annular binder.
Figure 3:
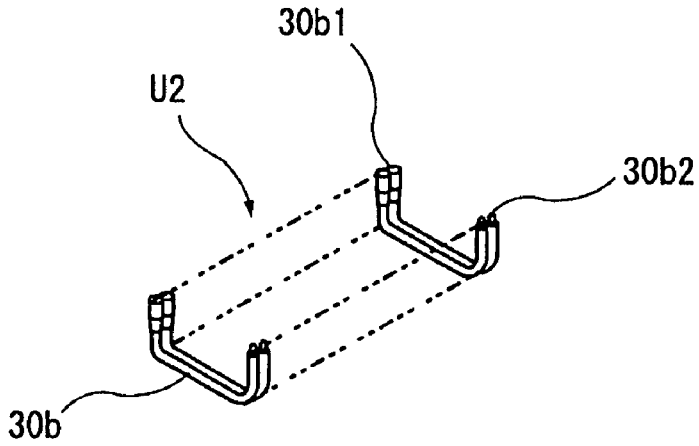

A bookbinding device 10 of this embodiment is described based on FIGS. 1 to 3. In the bookbinding device 10, a recording sheet S has at its end a plurality of binding holes S1 formed so as to penetrate through the recording sheet S, and the recording sheets S are bundled to be bound at the binding holes S1, whereby the bound sheet bundle is provided as a booklet. The bookbinding device 10 includes a plurality of annular binders 30 corresponding to the binding holes S1 of the recording sheets S, and a part of the annular binder 30 is inserted into each of the binding holes S1 to be engaged. The annular binders 30 are inserted into the corresponding binding holes S1 to bind the sheet bundle, whereby the bound sheet bundle is provided as a booklet.

(Recording Sheet S)

A recording sheet S has a rectangular shape, but the size and shape are not especially limited. The paper quality, thickness, and the like of the recording sheet S are also not limited. Further, an unrecorded blank sheet or a printed sheet can also be used.

The recording sheet S has at its one end a plurality of binding holes S1 formed so as to penetrate through the recording sheet S. The size and number of the binding holes S1 are not limited. The binding holes S1 may be formed for each one recording sheet S. Alternately, all binding holes S1 may be formed together in a bundle of the recording sheets S.

(Annular Binder 30)

The annular binder 30 of this embodiment, as shown in FIG. 2A, includes a pair of U-shaped binding members 30*a* and 30*b*. The binding members 30*a* and 30*b* are formed of, for example, a metal or a resin into the same shape. The binding member 30*a* has at its one end a fitting concave part 30*a*1 and at the other end a fitting convex part 30*a*2. The binding member 30*b* has at its one end a fitting concave part 30*b*1 and at the other end a fitting convex part 30*b*2. In the pair of binding members 30*a* and 30*b*, the fitting convex parts 30*a*2 and 30*b*2 are press-fitted respectively into the fitting concave parts 30*a*1 and 30*b*1, and the respective ends are engaged in a concavo-convex manner with each other, whereby the binding members 30*a* and 30*b* are unified.

The structure of the annular binder 30 is not limited to the one shown in FIG. 2A. For example, a pair of binding members may have different shapes from each other, or when the end of one binding member is a fitting concave part, the end of the other binding member may be a fitting convex part. The concavo-convex engagement is not limited to press-fitting, and both ends may be engaged, whereby the binding members may be unified. At both ends of the annular binder 30, as shown in FIG. 2B, a conical engagement hole 30*a*11 is provided in the fitting concave conical engagement protrusion 30*b*22. The conical engagement protrusion 30*b*22 and the conical engagement hole 30*a*11 may be unified so that the conical engagement protrusion 30*b*22 is not disengaged from the conical engagement hole 30*a*11 once the conical engagement protrusion 30*b*22 is engaged with the conical engagement hole 30*a*11. The annular binder 30 may not be constituted by unifying separated members, and, as shown in FIG. 2C, the annular binder 30 may have such a structure that can open and close around a supporting point.

(Binding Member Units U1 and U2)

In this embodiment, as shown in FIG. 3, a plurality of the U-shaped binding members 30*a*, which are one of the pair of binding members, are aligned to be adhered with an adhesive and, thus, to provide a U-shaped binding member unit U1. Meanwhile, a plurality of the U-shaped binding members 30*b*, which are the other binding members, are aligned to be adhered with an adhesive and, thus, to provide a U-shaped binding member unit U2. The U-shaped binding member units U1 and U2 have the same configuration and they can be easily manufactured at a low cost.

Although the U-shaped binding members are adhered with an adhesive to provide the binding member units U1 and U2, a metal or resin plate member is incised, whereby the binding member may be in a separable state. The binding members 30*a* and 30*b* are disposed so as to be aligned and constitute respectively the binding member units U1 and U2 which can be separated one by one, whereby the binding members 30*a* and 30*b* can be continuously inserted through the binding holes S1 to be engaged, and thus a sheet bundle can be easily and reliably bound to be provided as a booklet.

(Annular Binder Mounting Means 10*f*)

In the annular binder mounting means 10*f* of this embodiment, as shown in FIG. 1, the binding member unit U1 is stored in one holder 31*a*, and the holder 31*a* is covered by a lid 32*a* provided in an openable and closable manner. The binding member unit U1 is stored in the holder 31*a* so that the fitting concave part 30*a*1 and the fitting convex part 30*a*2 of the binding member 30*a* face the front side of a bundle of the recording sheets S. The holder 31*a* has an opening 31*a*1, and the binding members 30*a* located at the end of the binding member unit U1 are separated one by one to be pushed out through the opening 31*a*1.

The holder 31*a* includes biasing means 33*a* disposed therein. The biasing means 33*a* includes a coil spring 33*a*1 and a slider 33*a*2. The coil spring 33*a*1 biases the binding member unit U1 in the direction of the opening 31*a*1 through the slider 33*a*2.

Pushing means 39*a* is disposed so as to face the opening 31*a*1. The pushing means 34*a* has a pushing piece 34*a*1. The pushing means 34*a* is reciprocated by pushing drive means 35*a* constituted of a cylinder and the like and separates, one by one, the binding members 30*a* located at the end of the binding member unit U1 to push the binding members 30*a* out of the holder 31*a*.

The binding member unit U2 is, as shown in FIG. 1, stored in a holder 31*b* and covered by a lid 32*b* provided in an openable and closable manner. The binding member unit U2 is stored in the holder 31*b* so that the fitting concave part 30*b*1 and the fitting convex part 30*b*2 of the binding member 30*b* face the rear side of the bundle of the recording sheets S. The holder 31*b* has an opening 31*b*1, and the binding members 30*b* located at the end of the binding member unit U2 are separated one by one to be pushed out through the opening 31*b*1.

The holder 31*b* includes biasing means 33*b* disposed therein. The biasing means 33*b* includes a coil spring 33*b*1 and a slider 33*b*2. The coil spring 33*b*1 biases the binding member unit U2 in the direction of the opening 31*b*1 through the slider 33*b*2.

Pushing means 34*b* is disposed so as to face the opening 31*b*1. The pushing means 34*b* has a pushing piece 34*a*1. The pushing means 34*a* is reciprocated by pushing drive means 35*b* constituted of a cylinder and the like and separates, one by one, the binding members 30*b* located at the end of the binding member unit U2 to push the binding members 30*b* out of the holder 31*b*.

In the bookbinding method including a bookbinding processing for binding one end of a sheet bundle, the binding members 30*a* located at the end of the binding member unit U1 are separated one by one to be pushed out, and the binder members 30*b* located at the end of the binding member unit U2 are separated one by one to be pushed out. The respective one ends of the binding members 30*a* and 30*b* are inserted into each of the binding holes S1 of the sheet bundle to be engaged in a concavo-convex manner with each other, whereby the binding members 30*a* and 30*b* are unified.

As described above, a part of the annular binder 30 is inserted into each of the binding holes S1 to be engaged, and by virtue of the insertion of the annular binder 30 into the corresponding binding hole S1, the sheet bundle can be easily and reliably bound to be provided as a booklet. The sheet bundle can be reliably bound depending upon the thickness, bookbinding defects are eliminated, and a high-quality booklet can be provided.

The annular binder 30 includes the pair of U-shaped binding members 30*a* and 30*b*, whereby such a simple structure is provided that a part of the pair of binding members 30*a* and 30*b* is inserted into the binding holes S1 of a sheet bundle, and the respective ends of the binding members 30*a* and 30*b* engage with each other, whereby the binding members 30*a* and 30*b* are unified. In addition to the provision of the simple structure, binding defects such as a folding defect can be prevented.

The binding members 30*a* and 30*b* are disposed so as to be aligned and constitute respectively the binding member units U1 and U2 which can be separated one by one. Consequently, the binding members 30*a* and 30*b* can be continuously inserted into the binding holes S1 to be engaged, whereby a sheet bundle can be easily and reliably bound to be provided as a booklet.

The binding members located at the end of one of the binding member units are separated one by one to be pushed out, and the other binding members located at the end of the other binding member unit are separated one by one to be pushed out. The respective one ends of the binding members are inserted into each of a plurality of binding holes of a sheet bundle to engage with each other, whereby the binding members are unified. According to this constitution, the sheet bundle can be reliably bound depending upon the thickness, bookbinding defects can be eliminated, and a high-quality booklet can be provided.

Figure 4:
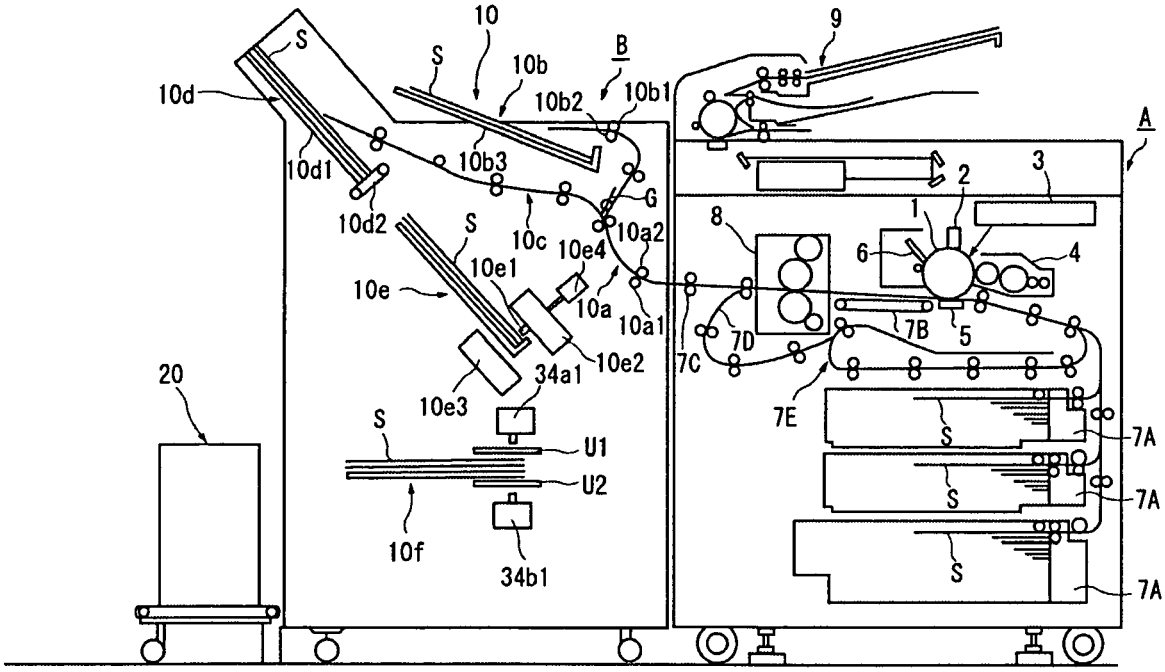
FIG. 4 is an entire configuration diagram of an image forming system including an image forming apparatus and a sheet post-processing apparatus.

Next, an image forming system including the bookbinding device 10 is described based on FIG. 4. The image forming system includes an image forming apparatus A and a sheet post-processing apparatus B.

Image Forming Apparatus A

The image forming apparatus A of this embodiment has image forming means which includes charging means 2, image exposure means 3, image developing means 4, transfer discharging means 5, and cleaning means 6 disposed around a rotating image carrier 1. In the image forming means, the charging means 2 uniformly charges the surface of the image carrier 1; thereafter, exposure scanning based on image data read from a document is performed by virtue of a laser beam from the image exposure means 3 to form a latent image. The latent image is inversely developed by the image developing means 4 to form a toner image on the surface of the image carrier 1.

The recording sheet S fed from sheet storage means 7A is conveyed to a transfer position. A toner image is transferred onto the recording sheet S by the transfer discharging means 5 at the transfer position, and thereafter, the electric charge on the recording sheet S is removed to be separated from the image carrier 1, and, thus, to be conveyed by conveying means 7B. Subsequently, the transferred image is heated and fixed by fixing means 8, and the recording sheet S is discharged from a discharge roller 7C.

When an image is formed on both sides of the recording sheet S, the recording sheet S with the transferred image heated and fixed by the fixing means 8 is branched from a usual sheet discharge path by virtue of conveying path switching means 7D and then switched back to be inverted upside down in inversion conveying means 7E. Thereafter, the recording sheet S passes the image forming means again, and an image is formed on the rear side of the recording sheet S. The recording sheet S transferred with the image passes through the fixing means 8 to be discharged outside the apparatus through the discharge roller 7C. The discharged recording sheet S through the discharge roller 7C is fed into the bookbinding device 10.

After image processing, any developer remaining on the surface of the image carrier 1 is removed by cleaning means 6, in preparation for the next image formation.

The image forming apparatus A includes an automatic document reading device 9 provided on the upper portion. The automatic document reading device 9 reads image data from a document, and exposure scanning based on the image data read from the document is performed by the laser beam from the image exposure means 3 to form a latent image.

Sheet Post-Processing Apparatus B

As shown in FIG. 4, the sheet post-processing apparatus B includes the bookbinding device 10 and a Booklet taking-out device 20. The bookbinding device 10 and the Booklet taking-out device 20 are arranged in a row. The bookbinding device 10 is disposed at the post stage of the image forming apparatus A, and the Booklet taking-out device 20 is disposed at the post stage of the bookbinding device 10.

Bookbinding Device 10

As shown in FIG. 4, the bookbinding device 10 includes sheet conveying means 10*a*, sheet discharging means 10*b*, bookbinding conveying means 10*c*, loading means 10*d*, binding hole forming means 10*e*, and annular binder mounting means 10*f*. Those means are arranged in a vertical line in a substantially vertical direction in the bookbinding device 10.

(Sheet Conveying Means 10*a*)

The recording sheet S introduced into the sheet conveying means 10*a* is held between conveying rollers 10*a*1 and 10*a*2 to be conveyed. Conveying path switching means G is operated by setting of sheet discharge conveyance or bookbinding conveyance, and the recording sheet S is introduced into either the sheet discharging means 10*b* or the bookbinding conveying means 10*c* by the conveying path switching means G.

(Sheet Discharge Means 10*b*)

When the sheet discharge conveyance is set, the conveying path switching means G blocks the conveying path to the bookbinding conveying means 10*c* and opens the conveying path to the sheet discharging means 10*b*.

The recording sheet S passing through the conveying path of the sheet discharging means 10*b* is held between conveying rollers 10*b*1 and 10*b*2 to be conveyed upward and, thus, to be discharged onto a discharge tray 10*b*3, provided in the uppermost portion of the apparatus, and stored therein. The discharge tray 10*b*3 can directly receive the recording sheet S, discharged from the image forming apparatus A, and load thereon.

(Bookbinding Conveying Means 10*c*)

The recording sheet S introduced into the bookbinding conveying means 10*c* by the conveying path switching means G is held between conveying rollers 10*c*1 and 10*c*2 to be stored at a predetermined position of the loading means 10*d*.

(Loading Means 10*d*)

The loading means 10*d* has a sheet-placing table 10*d*1 disposed at a slant and a movable sheet rear end positioning member 10*d*2. A predetermined number of recording sheets S are loaded on the sheet placing table 10*d*1, and the recording sheets S, each formed with a document toner image, are loaded in sequence to be bundled and, thus, to be conveyed to the binding hole forming means 10*e*.

(Binding Hole Forming Means 10*e*)

The binding hole forming means 10*e* includes a punch body 10*e*2 having a plurality of punches 10*e*1 and a punch table 10*e*3. In this embodiment, the punch body 10*e*2 is configured to be reciprocated by punch-driving means 10*e*4 constituted of a cylinder and the like. A predetermined number of the recording sheets S are put on the punch table 10*e*3, and the punch body 10*e*2 is moved to the direction of the punch table 10*e*3 by the punch driving means 10*e*4, whereby the binding holes S1 are formed in the predetermined number of recording sheets S by the punches 10*e*1. In this way, the binding holes S1 are formed so as to penetrate through one end of a bundle of a predetermined number of the recording sheets S, and the predetermined number of recording sheets S formed with the binding holes S1 are conveyed to the annular binder mounting means 10*f*.

(Annular Binder Mounting Means 10*f*)

The annular binder mounting means 10*f* separates, one by one, the binding members 30*a* and 30*b* to push out the separated respective binding members out of the binding member units U1 and U2, whereby a part of the annular binder 30 is inserted into each of the binding holes S1 of a bundle of the recording sheets S to be engaged and, thus, to provide a booklet. Since the recording sheet S, the annular binder 30, the binding member units U1 and U2, and the annual binder mounting means 10*f* have been described above, their descriptions are omitted.

Booklet Taking-Out Device 20

In the Booklet taking-out device 20, the sheet bundles bound by the annular binder 30 are fed from the bookbinding device 10 to be stacked in sequence. An operator can freely take out the sheet bundle as a booklet from the Booklet taking-out device 20.

Figure 5:
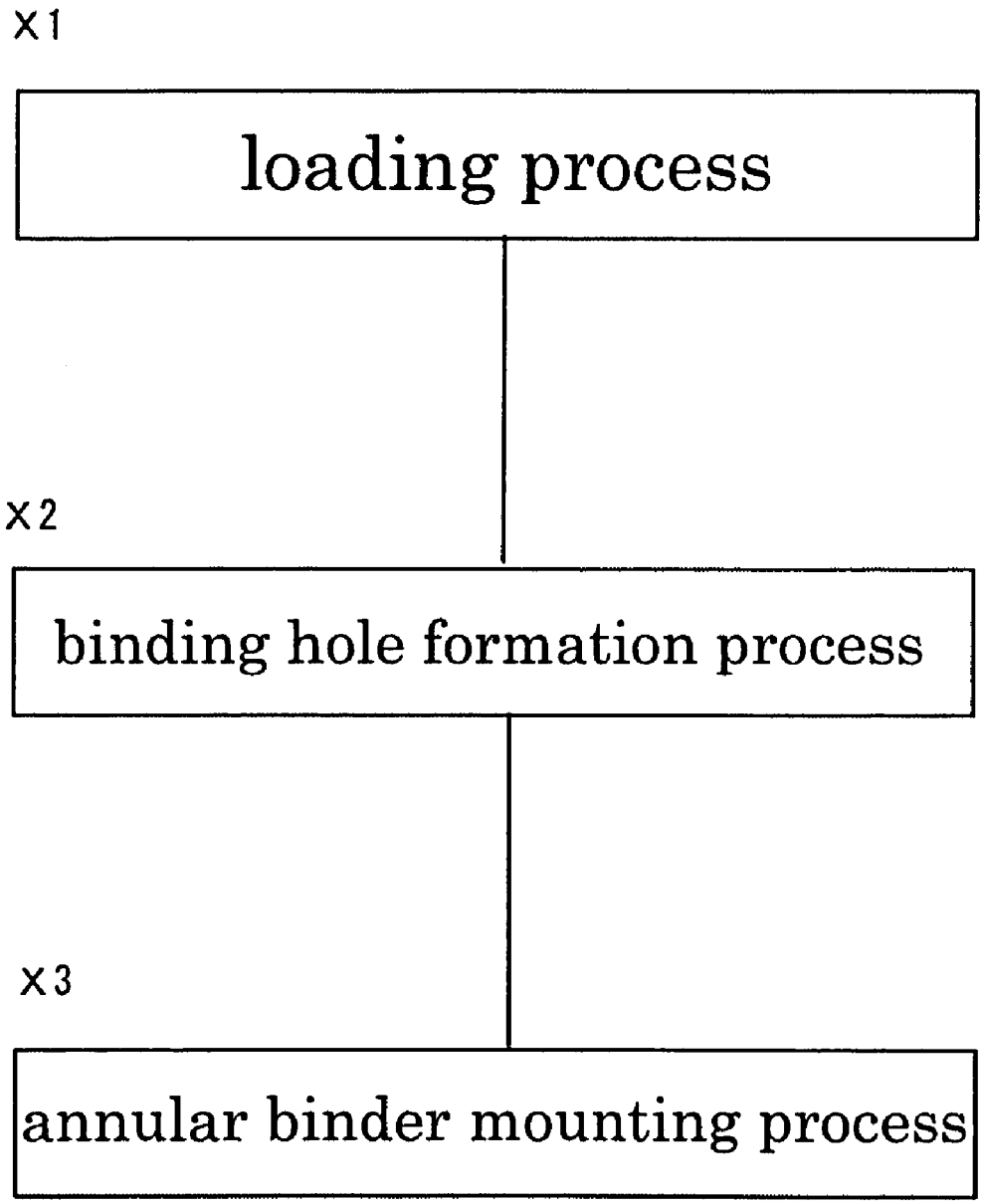
FIG. 5 is a flow chart of a bookbinding method for performing a bookbinding processing.

In the bookbinding processing for binding one end of a sheet bundle, as shown in FIG. 5, a loading process X1, a binding hole formation process X2, and an annular binder mounting process X3 are executed. In the loading process X1, the recording sheets S, each formed with a document toner image, are loaded in sequence. In the binding hole formation process X2, a plurality of the binding holes S1 are formed so as to penetrate through one end of the sheet bundle. In the annular binder mounting process X3, a part of the annular binder 30 is inserted into each of the binding holes S1 of the sheet bundle to be engaged. In the annular binder mounting process X3, the binding members 30*a* located at the end of the binding member unit U1 are separated one by one to be pushed out, and the binding members 30*b* located at the end of the binding member unit U2 are separated one by one to be pushed out. The respective one ends of the binding members 30*a* and 30*b* are inserted into each of the binding holes S1 of the sheet bundle to be engaged with each other, whereby the binding members 30*a* and 30*b* are unified.

This invention is applicable to a bookbinding device which provides a booklet from a bundle of recording sheet and, according to this invention, a sheet bundle can be reliably bound depending upon the thickness, bookbinding defects can be eliminated and a high-quality booklet can be provided.

DESCRIPTION OF REFERENCE NUMERALS

A Image-forming apparatus
B Sheet post-processing apparatus
10 Bookbinding device
10*a* Sheet conveying means
10*b* Sheet discharging means
10*c* Bookbinding conveying means
10*d* Loading means
10*e* Binding hole forming means
10*f* Annular binder mounting means
20 Booklet taking-out device
30 Annular binder
30*a*, 30*b* Binding member
30*a*1, 30*b*1 Fitting concave part
30*a*2, 30*b*2 Fitting convex part
U1, U2 Binding member unit

What is claimed is:

1. A bookbinding device for bundling recording sheets having a plurality of binding holes formed through an end thereof and binding the bundle of recording sheets with an annular binder at the plurality of binding holes to form a booklet of the bound bundle of recording sheets, comprising:

an annular binder comprising a pair of first and second binding members located in sequence so as to correspond to the binding holes, the first and second binding members being respectively pushed and moved so that a part of the pair of first and second binding members is inserted into a binding hole and the respective ends of the first and second binding members engage with each other to unify the first and second members, the pair of the first and second binding members being disposed in alignment and respectively constituting first and second binding members units which can be separated one by one;

a first holder having an opening through which the first binding members located at an end of the first binding member unit stored in the first holder are separated one by one and pushed out;

first biasing means for biasing the first binding member unit in the first holder in a direction of the opening;

first pushing means for separating, one by one, the first binding members, located at the end of the first binding member unit, to push the separated first binder member out of the first binding member unit;

a second holder having an opening through which second binding members located at an end of the second binding member unit stored in the second holder are separated one by one and pushed out;

second biasing means which is disposed in the second holder for biasing the second binding member unit in the direction of the opening; and second pushing means for separating, one by one, second binding members located at the end of the second binding member unit and pushing the separated second binding member out of the second binding member unit, wherein the first binding members located at the end of the first binding member unit are separated one by one and pushed out, the second binding members located at the end of the second binding member unit are separated one by one and pushed out, and the respective ends of the first and second binding members are inserted into each of the binding holes of the sheet bundle to engage with each other so that the first and second binding members are unified and bundled to be bound.

* * * * *